US005834073A

United States Patent [19]

Greenblat et al.

[11] Patent Number: 5,834,073

[45] Date of Patent: Nov. 10, 1998

[54] ACHIEVEMENT PLAQUE AND METHOD OF MAKING SAME

[75] Inventors: Alan P. Greenblat, Diamond Bar; John Banman, Brea, both of Calif.

[73] Assignee: Plastic Dress-Up Company, South El Monte, Calif.

[21] Appl. No.: 703,019

[22] Filed: Aug. 26, 1996

[51] Int. Cl.[6] ..... B44C 5/04

[52] U.S. Cl. ..... 428/13; 264/259; 425/127; 425/547; 428/542.2; 428/542.4; 428/913.3

[58] Field of Search ..... 428/13, 542.2, 428/913.3, 542.4; 264/259; 425/127, 547

[56] References Cited

U.S. PATENT DOCUMENTS

| | | | |
|---|---|---|---|
| 3,879,874 | 4/1975 | Broussard, Sr. | 428/542.4 X |
| 4,307,527 | 12/1981 | Suzuki | 264/259 X |
| 4,546,019 | 10/1985 | Schneider | 428/13 |
| 4,881,884 | 11/1989 | De'Ath | 425/127 X |
| 5,419,940 | 5/1995 | Wood et al. | 428/13 |
| 5,433,980 | 7/1995 | Auld et al. | 428/13 |

*Primary Examiner*—Henry F. Epstein
*Attorney, Agent, or Firm*—James E. Brunton

[57] ABSTRACT

An achievement award including a novel substantially transparent, injection molded acrylic plaque and a supporting base therefor. The display plaque is provided with a fossil-like, three-dimensional decorative design or image which appears to be embedded in the central body portion of the plaque. The display plaque uniquely includes strategically located bevels that give the plaque the appearance of expensive cut glass and, at the same time, functions to optically mask the mold lines which are formed during the injection molding process. The mold of the invention for use in injection molding the fossilized plaque includes several different types of mold inserts that can be positioned within the mold cavity so as to produce fossil-like designs within the body of the plaque of various shapes such as the shape of a golfer, a bowler, a basketball player and other types of athletic figures.

25 Claims, 10 Drawing Sheets

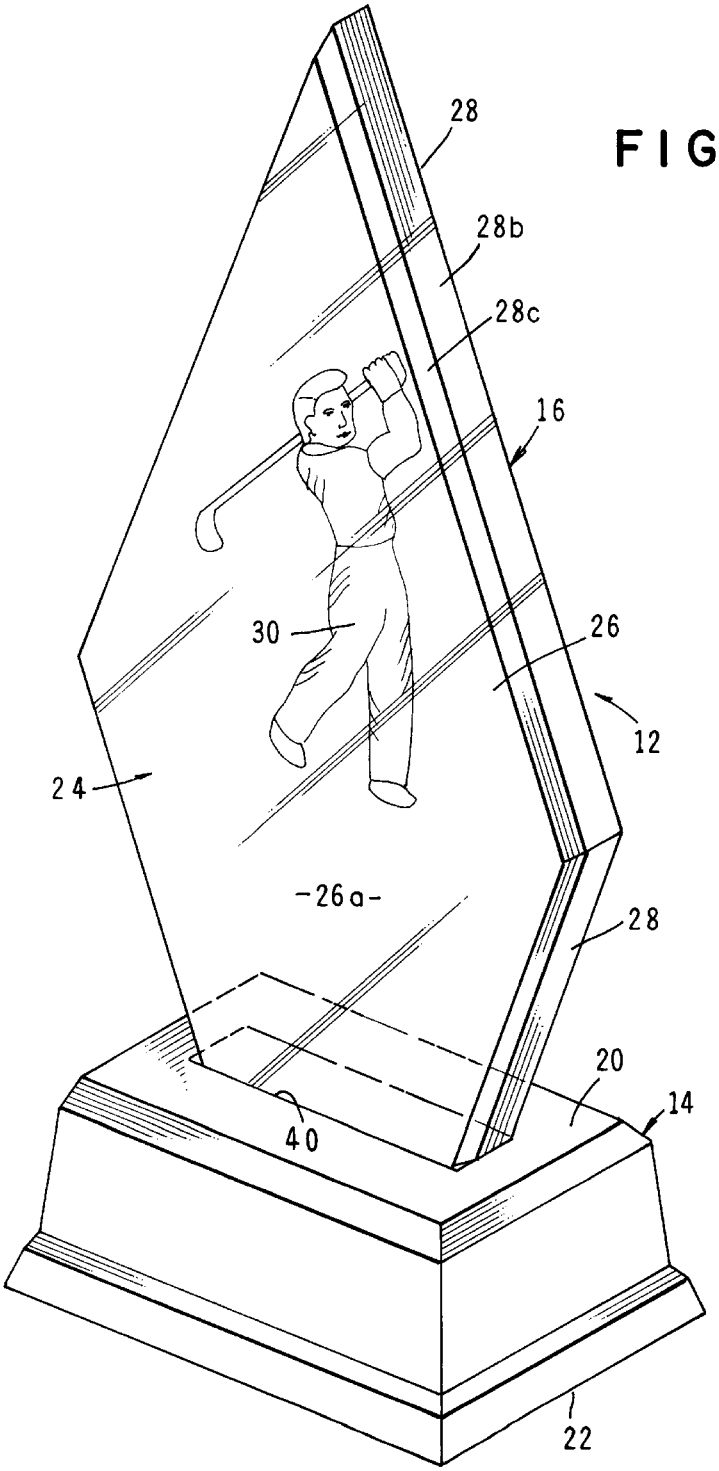
FIG. 1
FIG. 2
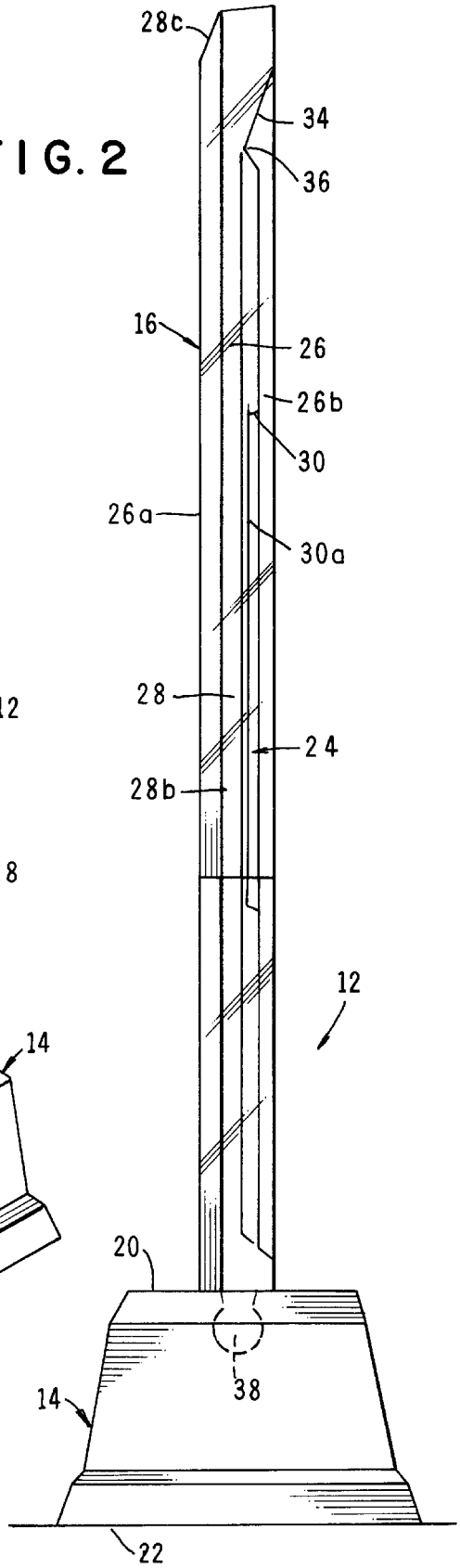

FIG. 17
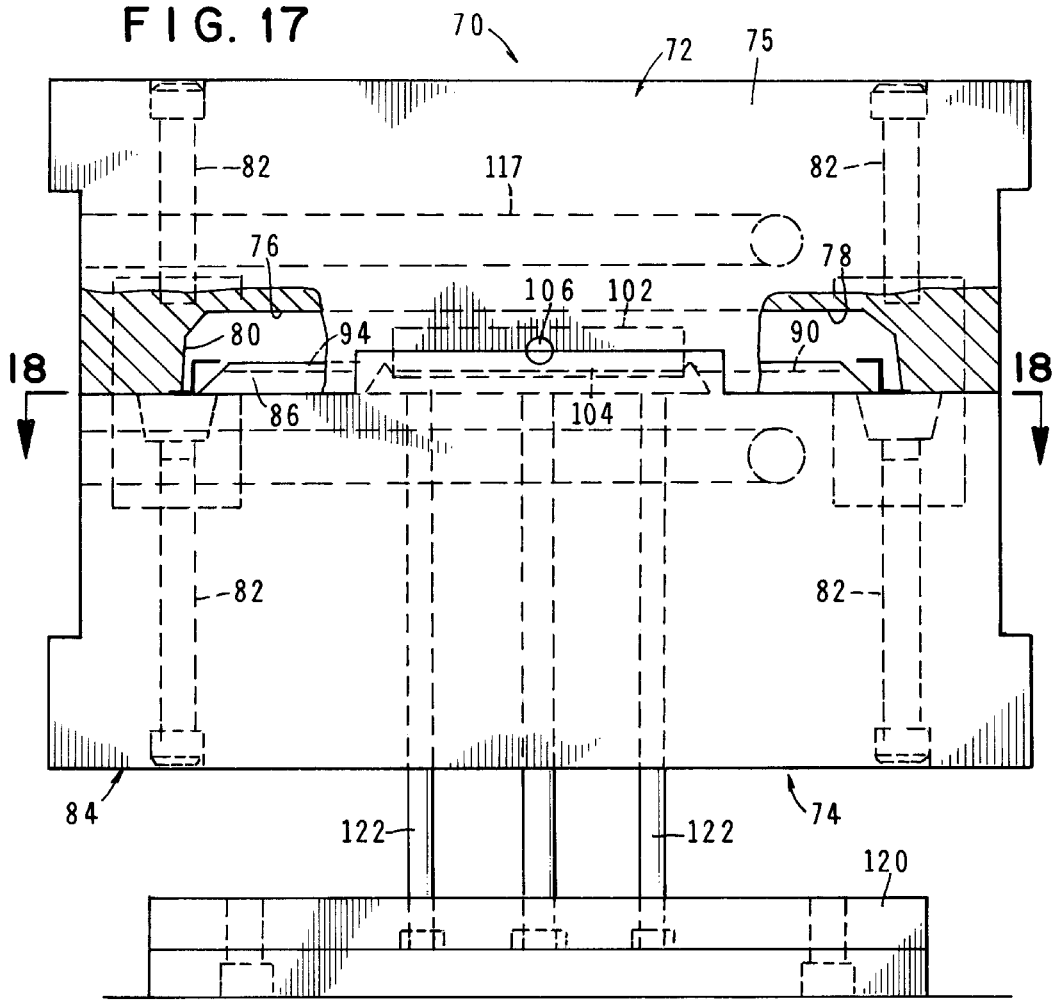
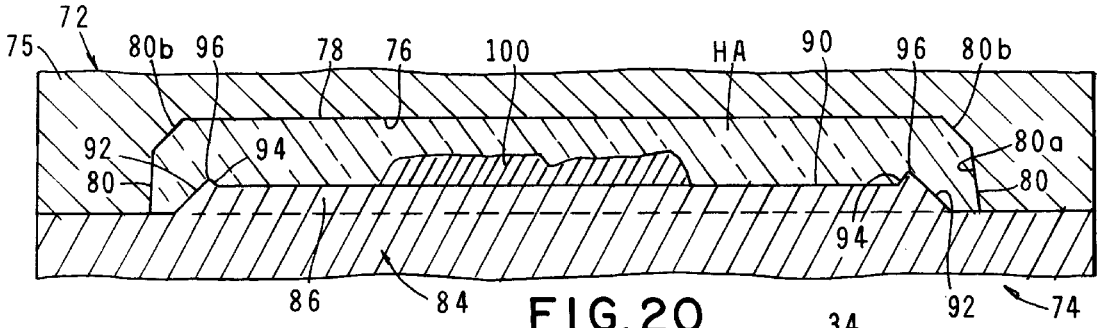
FIG. 20
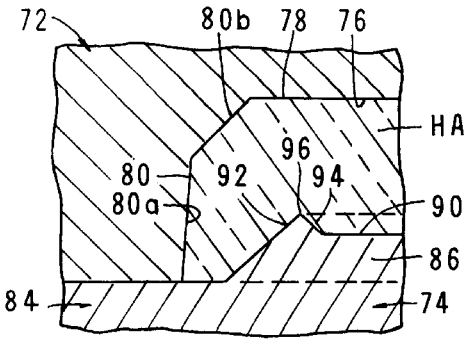
FIG. 21
FIG. 22
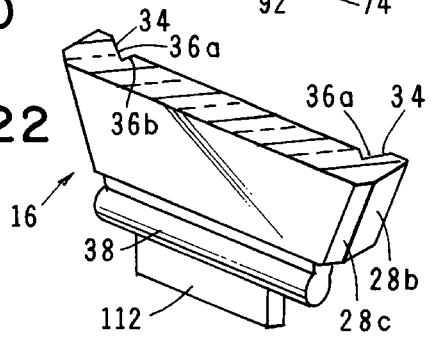

ACHIEVEMENT PLAQUE AND METHOD OF MAKING SAME

BACKGROUND OF THE INVENTION

1. Field of the Invention

The present invention relates generally to three dimensional achievement awards. More particularly, the invention concerns a novel injection molded acrylic plaque and the method of making same.

2. Discussion of the Invention

Achievement awards of various types are frequently given to individuals and athletic teams for outstanding achievements in sports such as golf, bowling, tennis, baseball, basketball and the like. These awards include medals, small statues and a number of different types of plaques which frequently take the form of inscribed commemorative tablets.

A very popular type of commemorative plaque is a plaque constructed from a clear acrylic tablet which is suitably mounted in a vertical orientation on a wooden or marble base. In many instances a decorative design such as a figure of a golfer, bowler or basketball player is engraved into the back wall of the plaque in a manner such that it can be viewed from the front of the plaque. When the plaque is then mounted in a vertical orientation on a suitable base, the engraved design appears to be suspended with the body of the plaque making the finished article quite attractive and quite suitable as an award for athletic achievement.

In the past the aforementioned types of plaques or tablets were typically constructed by first casting or appropriately cutting extruded sheets of suitable transparent plastic, such as an acrylic, into a desired shape, such as a triangle, oval or the like. Next the design, as for example the figure of a golfer, was engraved into the back surface of the tablet using a rotary or laser type engraver. When the design aspect was completed, the engraved tablet was then suitably mounted on a suitable type of pedestal or base. This type of prior art process is typically time consuming and quite expensive. Additionally, material selection is critical since the base material needs to be of a substantial thickness and be very clear so that the engraved image is properly viewable through the front surface of the tablet. Further, the material selected must permit easy, fracture-free engraving. Also, it is preferable that a frosted surface be provided on the walls of the image during the engraving step so the image will be properly highlighted when it is viewed through the front surface of the tablet.

Recognizing the drawbacks of the prior art processes and the substantial costs involved in making the aforementioned types of achievement award plaques, the present inventor developed a simple, elegant and much less expensive injection molding process for making the award plaques. In accordance with this novel, non-labor intensive process, the award plaques of the invention can be mass produced in a minimum time at relatively low cost. Additionally, because of the unique process developed by the present inventor, the finished product of the invention is of a substantially higher quality and is markedly superior in appearance when compared to plaques made by traditional prior art processes.

By way of example, in accordance with one form of the method of the invention, a plaque is produced which embodies a relatively thin front panel which is circumscribed by a beveled margin which gives the article a cut glass appearance. The thin front panel both reduces material costs and at the same time enhances the appearance of the decorative design which is molded, rather than engraved, into the face. Because the plaque is injection molded, the front panel and the facet-like margin, which frames the decorative design, can be constructed in one piece. Faceted surfaces such as those exhibited by the plaque of the invention are difficult, if not impossible, to create using the traditional prior art process. Because the decorative design is formed by a male insert, which comprises an interchangeable part of the injection mold, the exposed surfaces of the insert can be tailored to provide a frosted appearance to the design of whatever character may be desired to best highlight the design selected.

These and other advantages of the methods of the invention and the plaques produced thereby will become more apparent from the description which follows:

SUMMARY OF THE INVENTION

It is an object of the present invention to provide a novel, attractive and inexpensive injection molded achievement award and the method of making the same, which, in one embodiment of the invention, takes the form of a substantially transparent plaque of unique design that includes a fossil-like decorative design or image which appears to be embedded in the central body portion of the plaque.

It is another object of the invention to provide an achievement award of the aforementioned character which includes an attractive supporting base to which the transparent plaque is connected so that light will shine through the plaque in a manner to optically accentuate the fossil-like design aspect of the plaque.

Another object of the invention is to provide an achievement award of the type described in the preceding paragraphs which includes strategically formed bevels that give the plaque the appearance of expensive cut glass and also completely optically masks the mold lines generated during the injection molding process.

Another object of the invention is to provide a mold for injection molding the fossilized plaque which includes several different types of mold inserts that can be positioned within the mold cavity so as to produce fossil-like designs within the body of the plaque of various shapes, both figurative and non-figurative concept, such as the shape of a golfer, a bowler, a basketball player and other types of athletic figures, and abstract patterns and designs. The mold inserts are strategically formed with external surfaces that will cause the fossilized designs to take on a pleasing frosted appearance.

Another object of the invention is to provide a novel injection mold of the aforementioned character which is designed to form, on the bottom surfaces of the plaque, a connector element that can be used to conveniently interconnect the fossilized, injection molded plaque with a highly attractive, weighted base.

Another object of the invention is to provide a method of making achievement award plaques of the character described in the preceding paragraphs in which mold lines and other imperfections resulting from the injection molding process are substantially invisible to the viewer because they are optically obscured by strategically located bevels formed in the proximity of the mold lines.

Another object of the invention is to provide a method of the aforementioned character which enables the high volume, low cost production of extremely elegant, lightweight achievement award plaques that use less material and are markedly superior in several respects to similar plaques made by traditional, prior art mechanical or laser engraving processes.

Another object of the invention is to provide a method of the character described in the preceding paragraphs which is simple to accomplish, does not require the use of skilled labor to perform and one which is very non-labor intensive.

BRIEF DESCRIPTION OF THE DRAWINGS

FIG. 1 is a generally perspective view of one form of the achievement award article of the invention showing the injection molded acrylic, fossilized plaque portion of the award mounted on a support base.

FIG. 2 is an enlarged, side-elevational view of the achievement award article shown in FIG. 1.

FIG. 17 is an enlarged, end view of the mold shown in FIG. 16.

FIG. 20 is a cross-sectional view of the mold showing the mold cavity filled with the acrylic material that has been injected under high pressure into the mold chamber or cavity.

FIG. 21 is an enlarged, fragmentary, cross-sectional view of the left portion of the cavity of the mold showing the manner of formation of the critical mold line obscuring bevels of the device.

FIG. 22 is a fragmentary, generally perspective view of the lower portion of the acrylic plaque, which is produced using the mold shown in FIG. 16.

DESCRIPTION OF THE INVENTION

Figure 3:
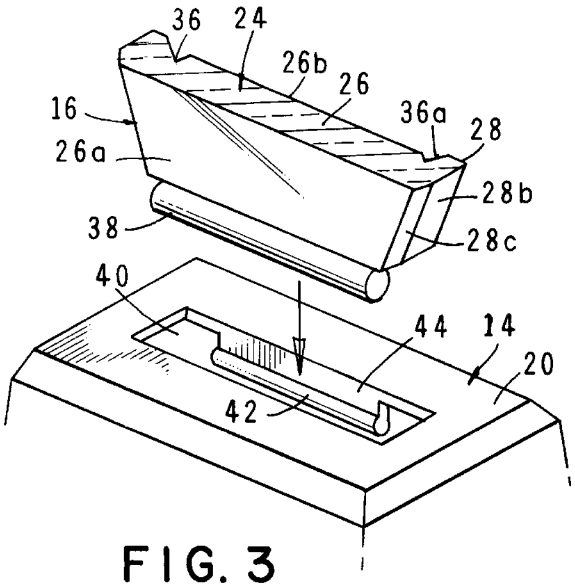
FIG. 3 is a fragmentary, perspective view showing one manner by which the acrylic plaque portion of the award is interconnected with the supporting base.
Figure 4:
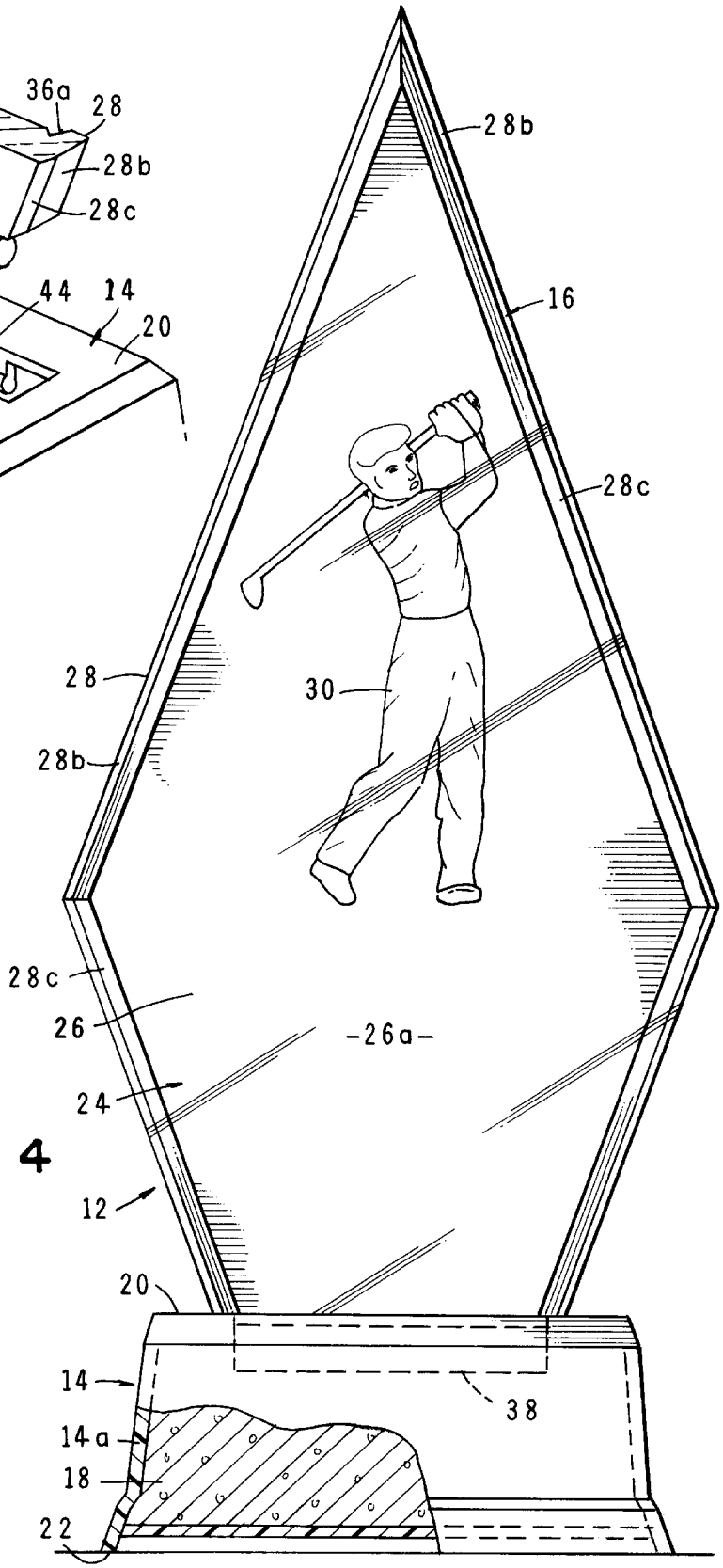
FIG. 4 is an enlarged, front-elevational view of the achievement award article shown in FIG. 1, partly broken away to show internal construction of the weighted base.
Figure 5:
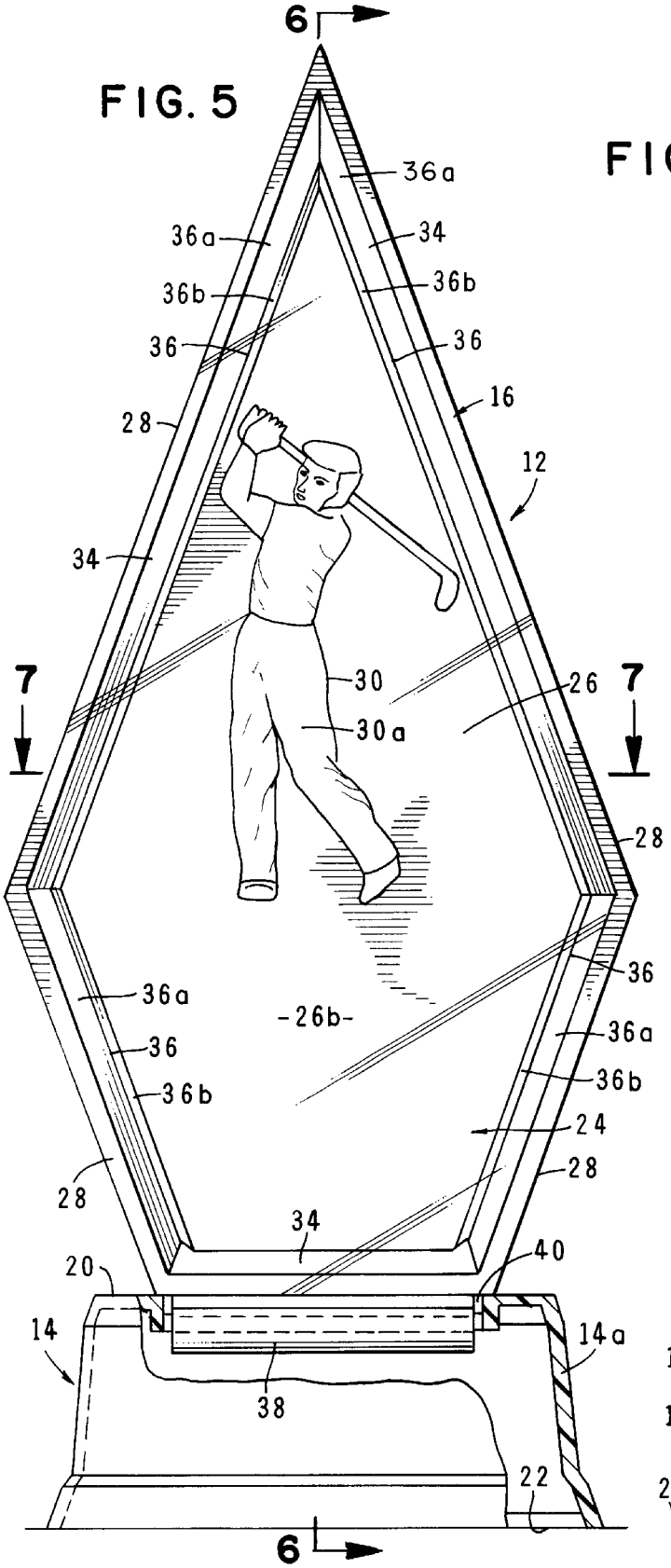
FIG. 5 is a rear view of the article of the invention with the base portion shown partly in section.

Referring to the drawings and particularly to FIGS. 1 through 7, one form of the achievement award article of the present invention is there illustrated and generally designated by the numeral 12. The article here comprises a supporting base 14 and an injection-molded, substantially transparent, injection molded acrylic plaque 16 which is connected to base 14. As indicated in FIG. 4, base 14 comprises a hollow structure 14*a* which is preferably filled with a suitable ballast material 18 such as plastic or metal to provide substantial weight thereto. In this regard, it is to be noted that base 14 includes an upper surface 20 and a lower table engaging surface 22. With this construction, when the base is positioned on a planar surface, it will tend to remain stationary.

Figure 6:
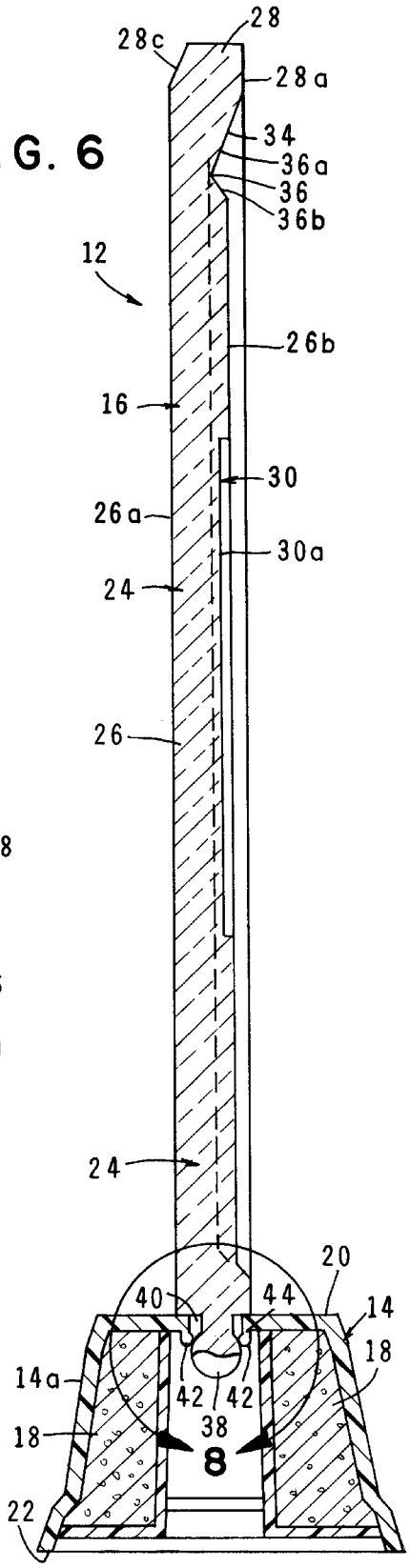
FIG. 6 is a cross-sectional view taken along lines 6—6 of FIG. 5.
Figure 7:
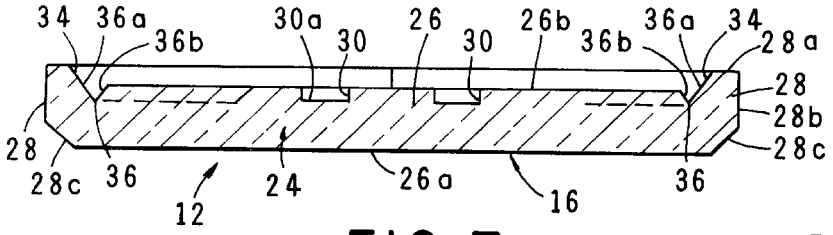
FIG. 7 is a cross-sectional view taken along lines 7—7 of FIG. 5.

Plaque 16 is of unique construction and, as best seen in FIG. 7, comprises an injection molded body 24 which includes a central, panel-like portion 26 of a first thickness and a marginal frame-like portion 28 of a second thickness greater than the thickness of the central portion 26. Central portion 26 includes a front face 26*a* and a rear face 26*b*. In a manner presently to be described, a unique fossil-like, concave, ornamental impression 30 is formed in the rear face of central body portion 26 and, as best seen in FIG. 2, extends outwardly, or forwardly, into central portion 26 in a direction toward forward face 26*a* (see also FIG. 6). Three dimensional impression 30, which is formed during the injection molding process, can be of a wide variety of shapes depending upon the nature of the achievement award. However, as shown in the drawings, impression 30 here taken the form of a person and more particularly the form of a golfer in a golf-club swinging motion. As previously mentioned, when the achievement award is to be used for other sports, impression 30 can take the shape of a bowler, a basketball player, a tennis player, or another appropriate type of athlete. Importantly, as a part of the molding process, impression 30 is provided with a front face 30*a* which is of a rough configuration so that the impression takes on a frosted appearance thereby making the features thereof clearly visible through front face 26*a* of the ornamental plaque.

As best seen in FIGS. 6 and 7, marginal portion 28 is provided with an angularly, inwardly extending wall 34 which circumscribes central portion 26 and functions to interconnect the rear surface 28*a* of marginal portion 28 with central portion 26 of the plaque body. Wall 34 cooperates with an angular wall 36*a*, which, in turn, cooperates with an angular wall 36*b* to define a generally V-shaped channel 36 which also circumscribes central portion 26 of the plaque body (FIG. 7). As will be discussed in greater detail in the paragraphs which follow, wall 34 along with V-shaped channel 36 perform the unique function of optically obscuring the mold lines formed on the plaque body during the injection molding process.

As shown in FIGS. 1 and 2, marginal portion 28 includes a side wall 28*b* which extends generally perpendicularly to front surface 26*a* of the plaque body. Marginal portion 28 further includes a bevel 28*c* provided in the form of an interconnecting wall which connects side wall 28*b* of the marginal portion with the forward face 26*a* of central portion 26 of the plaque body. Walls 28*c* and 34 along with walls 36*a* and 36*b* which define V-shaped channel 36 all function to give the injection molded plaque the unique appearance of cut glass.

Figure 8:
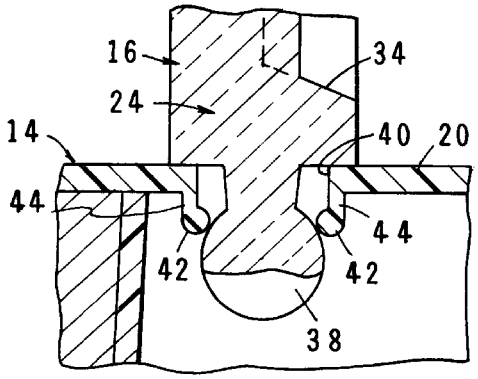
FIG. 8 is an enlarged, fragmentary, cross-sectional view of the area designated by the numeral 8 in FIG. 6.

Another important aspect of the injection molded plaque of the present invention comprises the provision of an outwardly extending connector means for interconnecting the plaque with the supporting base 14. As best seen by referring to FIGS. 5 and 6, this connector means is here provided in the form of an elongated, transversely extending, generally cylindrically shaped connector element 38 which is lockably receivable within a connector receiving channel 40 provided in upper surface 20 of base 14. As indicated in FIGS. 3 and 6, connector receiving channel 40 includes locking means for lockably engaging connector element 38. These locking means are here provided in the form of a pair of transversely extending, spaced-apart gripping means or protuberances 42 which are formed proximate the extremities of downwardly extending, spaced-apart legs 44. With this construction, as the injection molded plaque is mated with base 14, connector element 38 will be received within receiving channel 40. A downward force exerted on the plaque will then cause legs 44 to spread apart a sufficient distance to allow the connector element to pass therebetween. Once the connector element is fully extended into channel 40, legs 44, along with protuberances 42, will spring back into their original at-rest, locking position thereby blocking removal of the plaque from the supporting base (see also FIG. 8).

Figure 9:
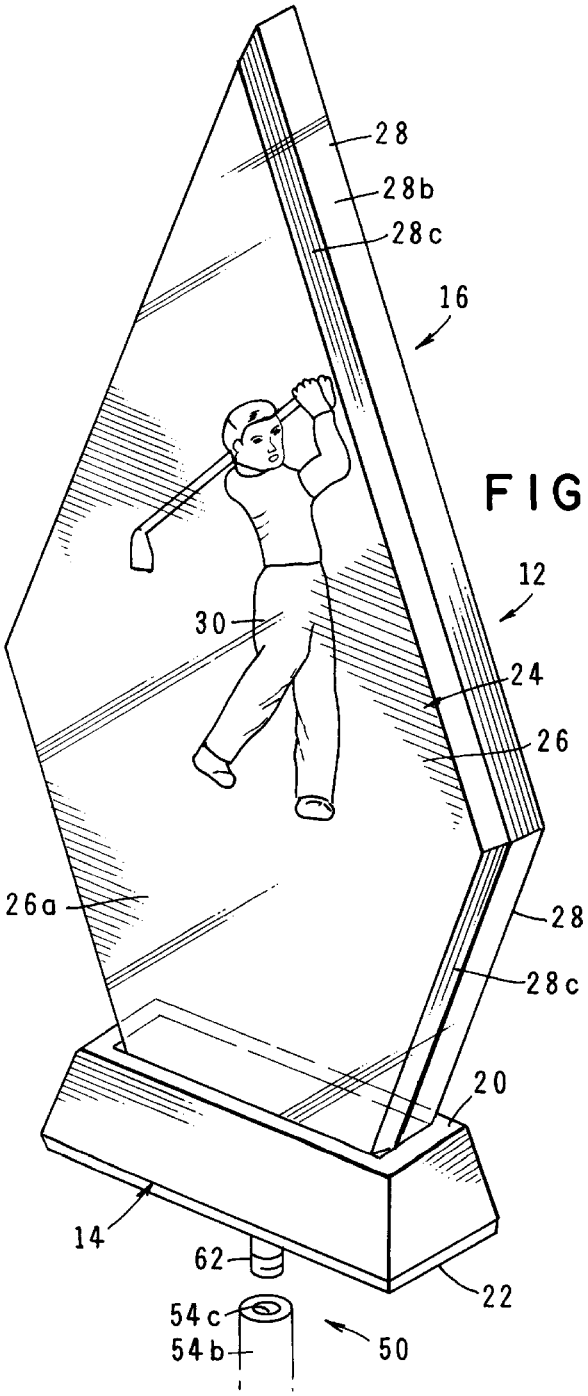
FIG. 9 is a generally perspective, exploded view of an alternate form of the achievement award article of the invention in which the base is provided in two cooperating parts which are interconnected by a threaded connector.
Figure 10:
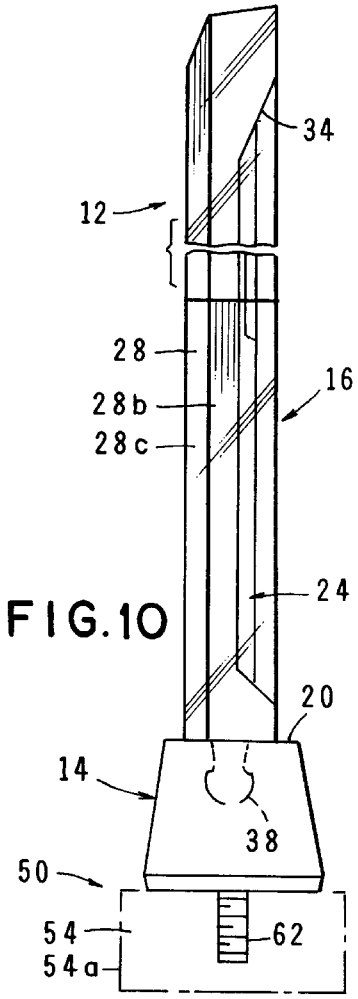
FIG. 10 is a side-elevational view further illustrating the manner of the interconnection of the two parts of the base.
Figure 11:
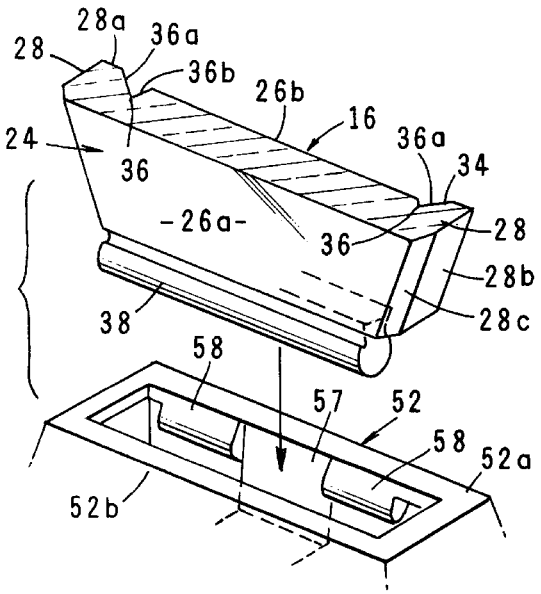
FIG. 11 is a fragmentary, exploded view of one method of the invention for interconnecting the acrylic plaque with the upper part of the support base.
Figure 12:
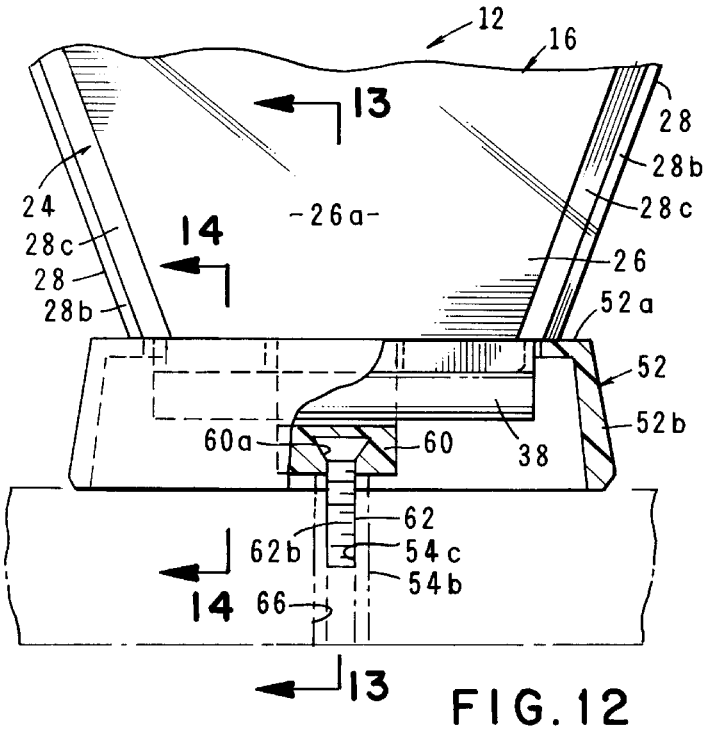
FIG. 12 is a fragmentary, front-elevational view partly in cross section further illustrating the manner of interconnection of the acrylic plaque with the base and the interconnection together of the two component parts of the base.

Turning to FIGS. 9 through 14, another form of the achievement award of the present invention is there illustrated. This form of the invention is similar in many respects to that shown in FIGS. 1 through 8 and like numbers are used to identify like components. More particularly, the injection molded plaque 16 is identical to that previously described, but the base is provided as a two-part structure generally identified in FIGS. 9 through 14 by the numeral 50. As best seen in FIGS. 10 and 12, structure 50 comprises a plaque supporting member 52 having an upper surface 52*a*, a hollow body portion 52*b* and a lower object engaging surface 52*c* (FIG. 12). The two-part base structure 50 also comprises a surface engaging member 54 having a body portion 54*a* which is provided with an insert 54*b* having a threaded bore 54*c* (FIGS. 9 and 12). Surface engaging member 54 can take on several forms such as a weighted, decorative base, a fanciful pedestal or several other types of plaque and structure supporting members used in the construction of achievement award articles.

Figure 14:
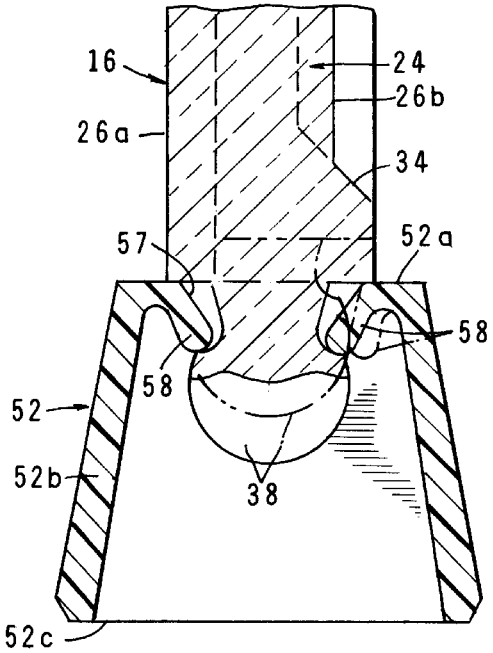
FIG. 14 is an enlarged, cross-sectional view taken along lines 14—14 of FIG. 12.
Figure 13:
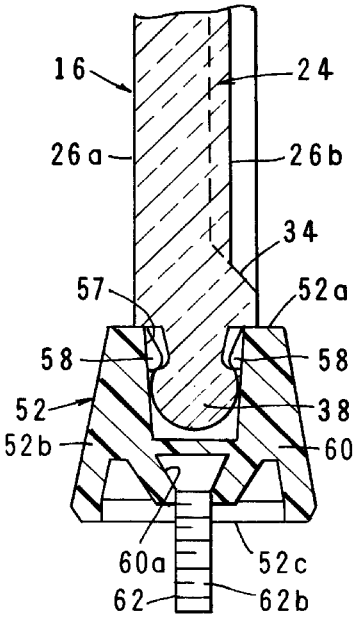
FIG. 13 is an enlarged, cross-sectional view taken along lines 13—13 of FIG. 12.

As best seen in FIGS. 11 and 13, plaque supporting member 52 includes a connector-receiving channel 57 within which is provided locking means for lockably engaging connector element 38 of the decorative plaque. These locking means are similar to the locking means provided in connection with the first embodiment of the invention herein described and comprises two pairs of gripping means or locking fingers 58 which are positioned on either side of opening 57. Disposed intermediate locking fingers 58 is a centrally located solid body 60, the purpose of which will presently be described (see FIG. 13). As indicated in FIG. 14, or locking fingers 58, are resiliently deformable so that, when connector 38 is inserted into opening 57, locking fingers 58 will spread apart. When the connector 38 is fully seated in the manner shown in FIG. 13, the locking fingers will spring back to their normal starting position thereby locking the decorative plaque against removal from base member 52 (see also FIG. 13).

In order to interconnect plaque supporting member 52 with surface engaging member 54, a second type of connector means is provided which is here shown in the form of a threaded connector 62 the head portion of which is received in a cavity 60*a* formed in solid body portion 60 (FIG. 13). Connector member 62 includes a threaded shank 62*b* which is threadably receivable within the previously identified, tubular-shaped insert 54*b* which is fixedly received within a bore 66 provided in the body portion of member 54. With this construction, base members 52 and 54 can readily be interconnected by threadably interconnecting threaded connector 62 with tubular shaped insert 54*b*.

Figure 15:
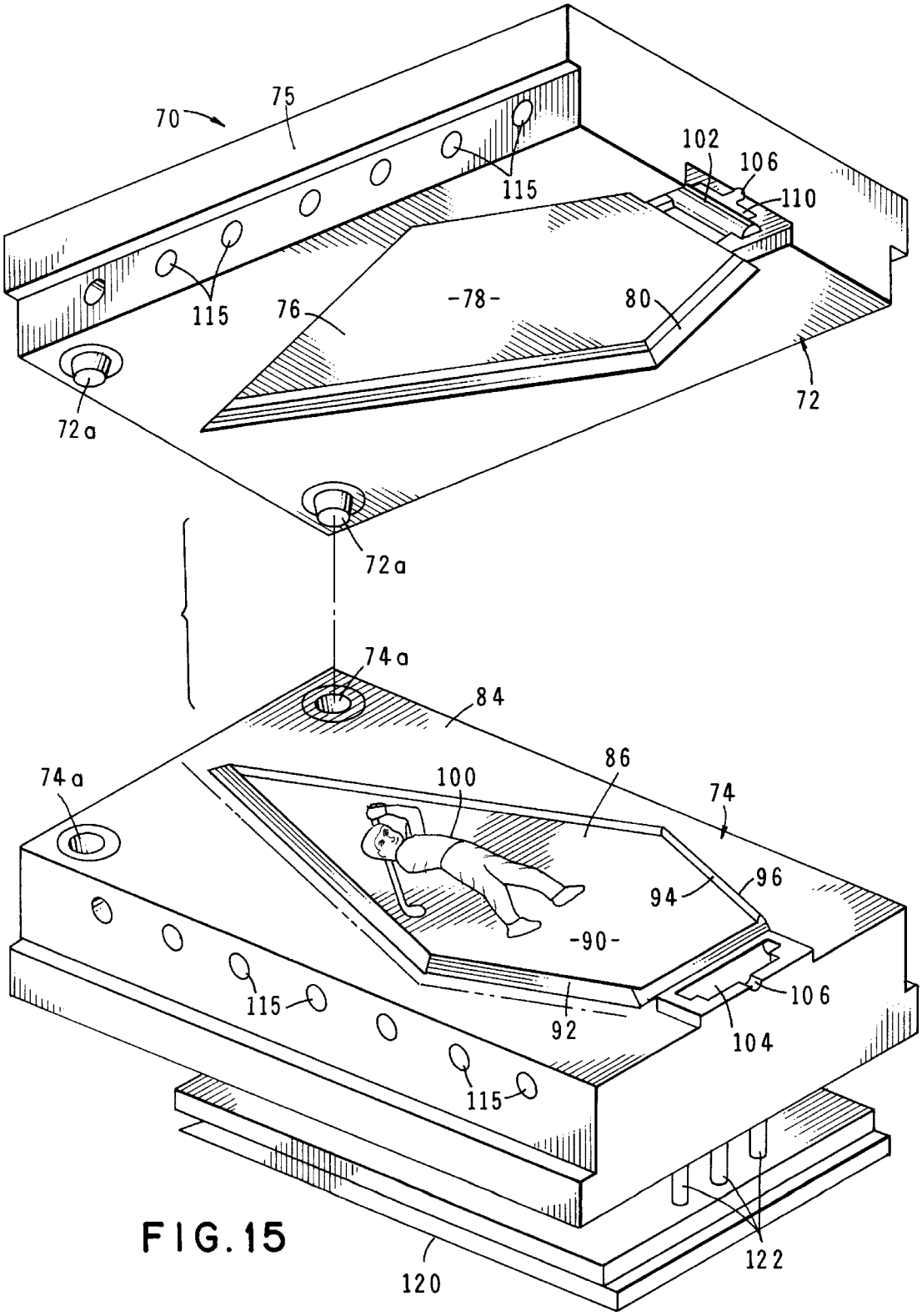
FIG. 15 is a generally perspective, exploded view of one form of the injection mold of the invention for injection molding the acrylic plaque component of the achievement award.
Figure 16:
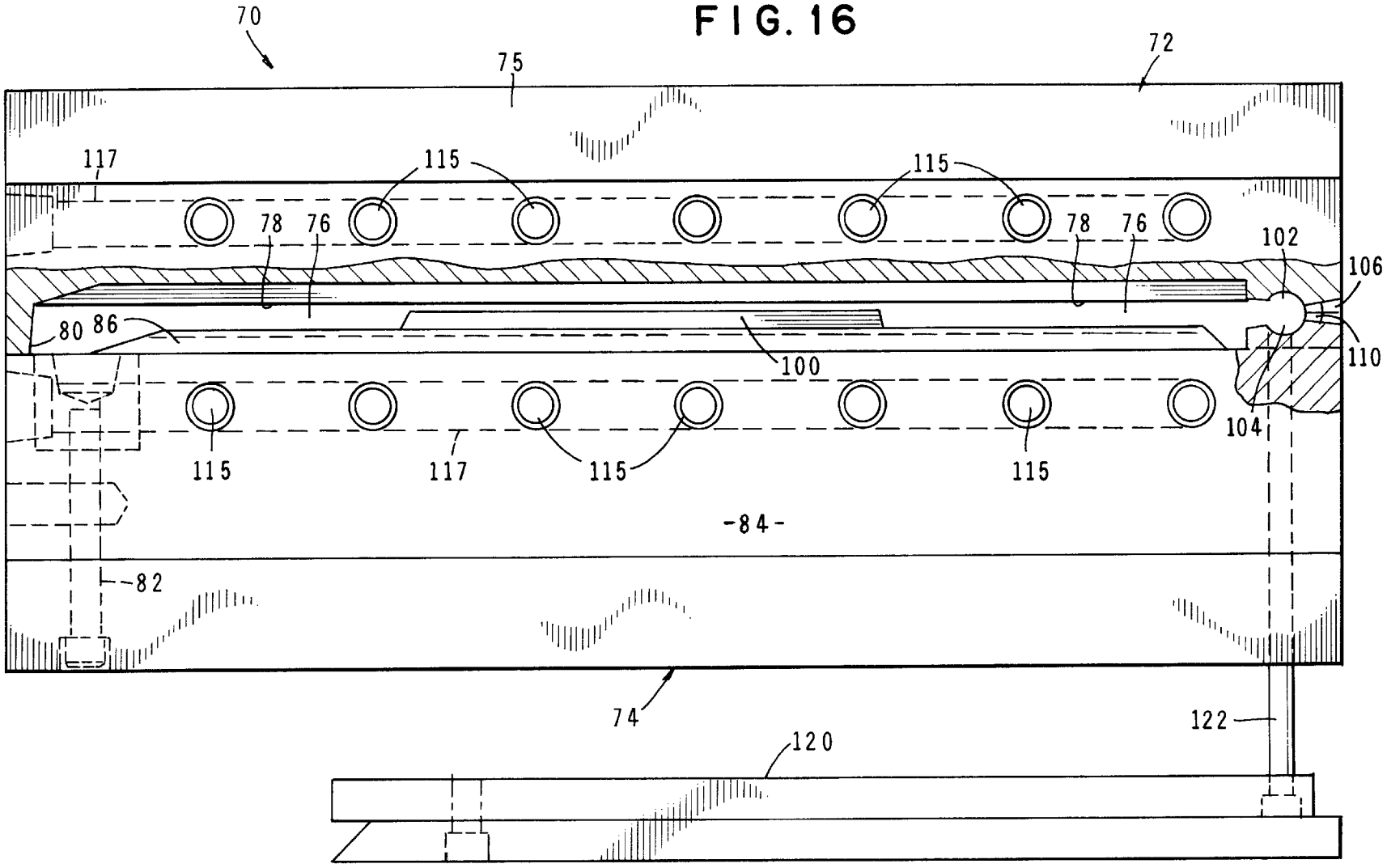
FIG. 16 is an enlarged, side-elevational view of the assembled mold, partly broken away to show internal construction.

Turning next to FIGS. 15, 16, and 17, one form of the injection mold of the invention for molding the achievement award plaque is there illustrated and generally designated by the numeral 70. In this form of the invention, the injection mold comprises first and second cooperating mold components 72 and 74. First mold component 72 includes a body portion 75 having a first central cavity 76 which is defined by a generally planar face 78 and a side wall 80. As shown in FIG. 15, side wall 80 is connected to and circumscribes planar face 78. Second mold component 74 which is removably connected to first mold component 72 by means of a plurality of connectors 82 (FIG. 17) and includes a body 84 having an upstanding portion 86 which, upon mating of the mold components, is partially receivable within cavity 76 of first mold component 72 (FIGS. 17 and 20).

Upstanding portion 86 includes a generally planar surface 90 which is circumscribed by angularly extending first and second walls 92 and 94. As best seen in FIGS. 15 and 20, wall 94 cooperates with wall 92 to define an angular-shaped, ridge-like protuberance 96 which circumscribes planar surface 90. With this construction, second wall 94 functions to interconnect generally planar surface 90 with first wall 92 (FIG. 20).

Forming an important aspect of the injection mold of the present form of the invention is a three-dimensional insert 100 which is supported by generally planar face 90 and, when the mold components are interconnected, extends into cavity 76 of first mold component 72 (FIG. 20). Insert 100 can be integrally formed with surface 90, but preferably is removably interconnected thereto so that the same mold can be used to mold decorative plaques having a variety of differently shaped, fossil-like impressions formed in the Lucite body thereof. Three dimensional insert 100 can be formed by various types of machine tools and can be molded by various processes. As may be desired, the insert can take the form of a person as, for example, a golfer, a bowler, a basketball player or other athlete which is to be the recipient of the achievement award. Mold components 72 and 74, as well as insert 100, can be constructed of various materials such as steel.

Referring particularly to FIG. 20, it can be seen that wall 80 which, along with surface 78 defines cavity 76, comprises a first, generally perpendicularly extending wall 80*a* and a second angularly extending wall 80*b*. During the molding process, these walls, of course, form surfaces 28*b* and 28*c* of the molded fossilized plaque (see FIG. 22). Similarly, surfaces 92 and 94 function to form walls 36*a* and 36*b* of the injection molded plaque 16. As previously mentioned, these walls cooperate to form bevels which give the plaque an elegant, cut glass appearance. To insure proper mating of the mold components, component 72 is provided with outwardly extending, spaced-apart guide protuberances 72*a* which are closely received within socket-like apertures 74*a* provided in mold component 74.

Figure 18:
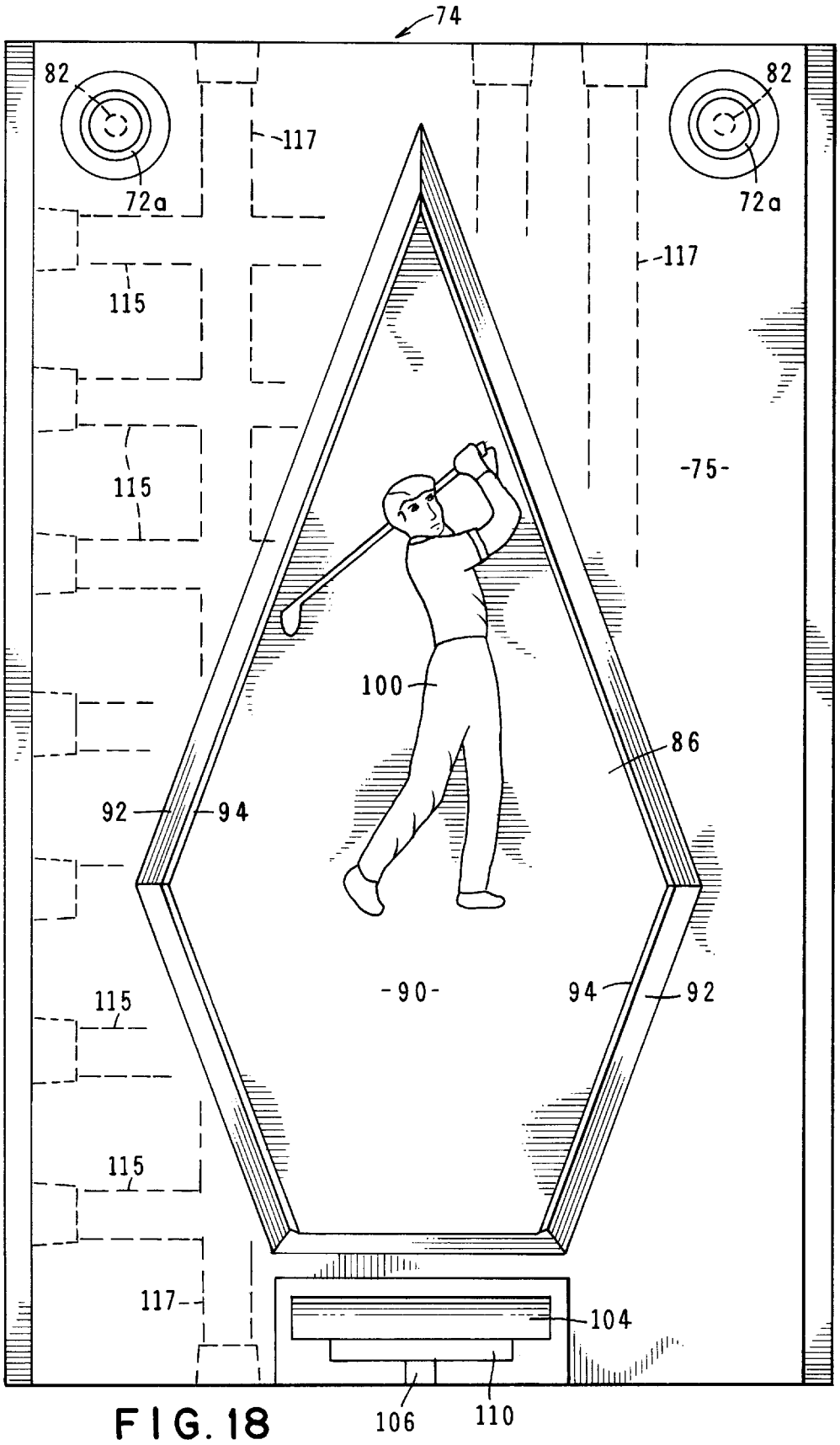
FIG. 18 is a plan view of one-half of the injection mold taken along lines 18—18 of FIG. 17.
Figure 19:
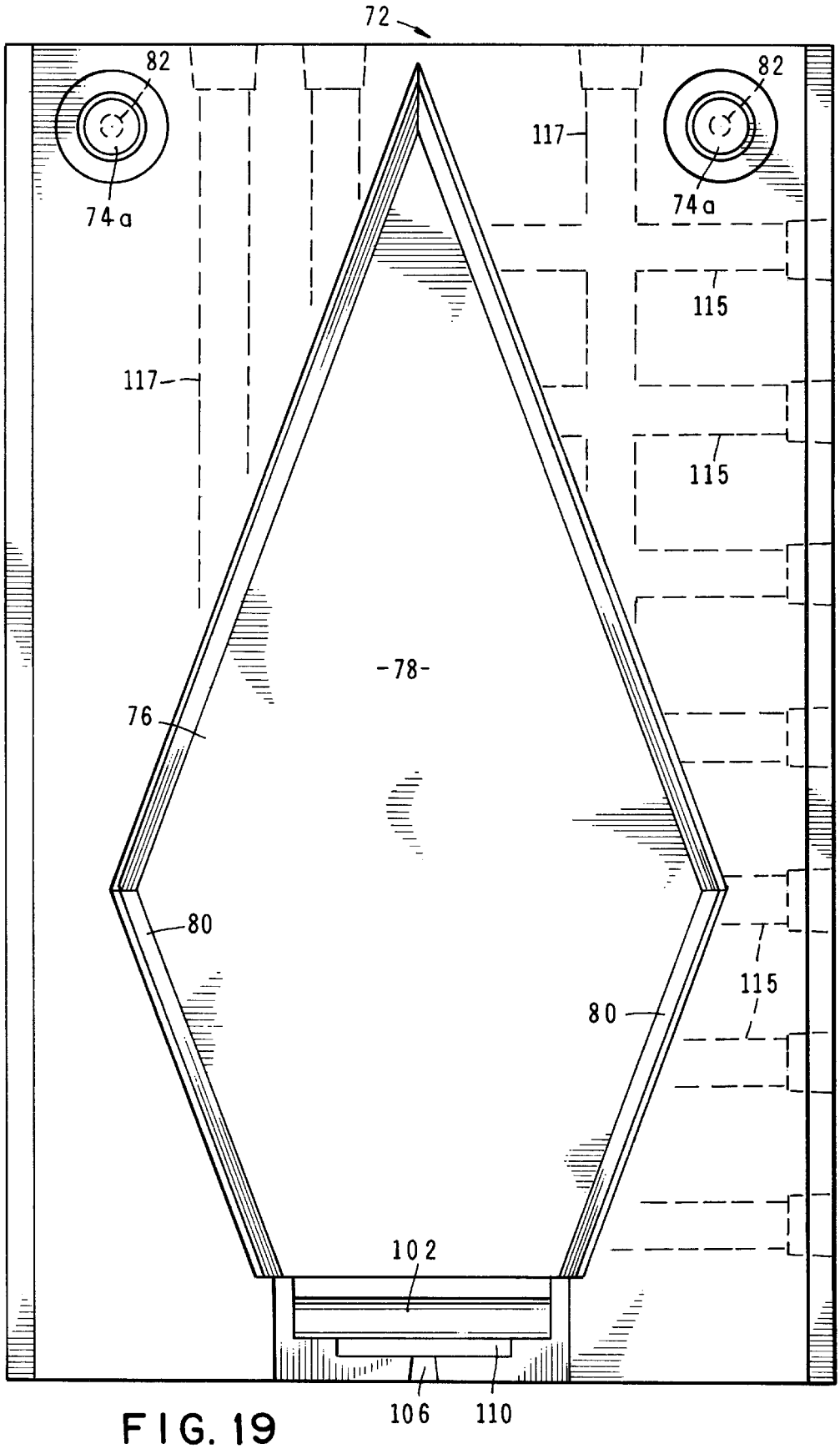
FIG. 19 is a plan view of the other half of the mold which mates with the half shown in FIG. 18.

Turning once again to FIG. 15, first mold component 72 is also provided with a second cavity 102 which is generally semi-circular in shape. Similarly, mold component 74 is provided with a second cavity 104 which aligns with cavity 102 when the mold components are interconnected. Mold cavities 102 and 104 cooperate to form the connector element 38 which is used to interconnect the decorative plaque with the supporting base. Cavities 102 and 104 are disposed proximate, and in fluid communication with, first cavity 76 and also are in communication with an injection passageway or gate 106 into which the heated acrylic is injected to fill the mold cavity during the molding process, the details of which will presently be described. As indicated in FIGS. 16 and 18, gate 106 initially communicates with a third cavity 110 which, in turn, communicates with second cavities 102 and 104 so that, during the molding process, a sprew 112 of the character shown in FIG. 22 will be formed. As part of the plaque finishing process, spew 112 is broken away from the molded component so that connector 38 takes on the smooth, semi-cylindrical appearance shown, as for example, in FIG. 11 of the drawings.

In accordance with the method of the invention for making an achievement award plaque, first and second mold components 72 and 74 are constructed in the configuration shown in FIGS. 15, 16 and 17. More particularly, first mold component 72 is constructed so as to have a body 75 provided with a cavity 76 of the character described in the preceding paragraphs. Similarly, second mold component 74 is constructed so as to have a body portion 74, that is, provided with an upstanding portion 86 of the configuration shown in the drawings and described in the preceding paragraphs.

Next, a three-dimensional insert 100 of the character previously described is constructed and interconnected with surface 90 of upstanding portion 86 of mold component 74. It is to be understood that three-dimensional insert 100 has an external surface defining the shape desired for the fossil-like cavity which is to be formed in the injection molded acrylic plaque. Insert 100 can, therefore, take on the character of a person such as a golfer, bowler, basketball player or other athlete. As previously mentioned the external surface of three-dimensional insert 100 is preferably selectively textured so as to provide a frosted appearance to the fossil-like cavity which is formed in the body of the acrylic plaque during the molding process. After three-dimensional insert 100 has been appropriately interconnected with surface 90 of the second mold component. The first and second mold components are interconnected so that upstanding portion 86, along with three-dimensional insert 100 extends partially into cavity 76 provided in first mold component 72 (see FIGS. 20 and 21). With the mold component 72 and 74 correctly mated and securely interconnected by connectors 82, the actual injection molding process can begin. This process is accomplished using a suitable type of commercially available injection molding machine, such as a machine manufactured and sold by the Stokes Company of Philadelphia, Pa., which machine is suitable for injection molding of various plastic materials including a suitable acrylic material.

Acrylic plastics comprise a broad array of polymers and copolymers in which the major monomeric constituents belong to two families of esters namely, acrylates and methacrylates. These are used singly or in combination as well as with functional substituted derivatives or monomers to give the desired product characteristics. In the present instance, the acrylic used in the molding process is formulated to provide a product which is relatively hard and exhibits crystal clarity. Such a product is readily commercially available in the form of molding pellets and powders and is well suited for producing the award plaques of the present invention. By way of example, an acrylic material sold by Brand Polymer Land of Los Angeles, Calif. under the designation V825 is suitable for use in carrying out the method of the invention.

In carrying out the method of the invention, after the mold component 72 and 74 have been sealably interconnected and with the appropriate insert 100 disposed within cavity 76, the mold can be positioned within the molding machine and the acrylic pellet materials heated to an elevated temperature of between about 400 and 480 degrees centigrade. After heating the acrylic pellet materials to a temperature within the aforementioned temperature range, the acrylic material at this elevated temperature is injected into injection passageway or gate 106 with an injection pressure of on the order of 13,000 pounds per square inch. As the heated material passes through gate 106, it will flow into cavities 110, 102, 104 and 76 in the manner shown in FIGS. 20 and 21, the heated acrylic being identified by the letters "HA". The heated acrylic is maintained within the mold under a holding pressure of approximately 13,000 pounds per square inch for a period of time of between 120 and 160 seconds.

Referring once again to FIGS. 15, 16, 17, and 18, it is to be noted that the mold of the form of the invention there shown is provided with a plurality of cooling channels 115 which extend transversely of the mold and are in fluid communication with a plurality of longitudinally extending cooling channels 117. As indicated in the drawings, channels 115 and 117 are provided in both first and second mold components 72 and 74 and are arranged to permit cooling fluids to flow around and about the mold cavity to enable controlled cooling thereof. In this regard, during the molding process cooling water is caused to flow through the cooling channels in both mold components at a temperature of on the order of approximately 180 degrees Fahrenheit. The operation of the molding machine, including the positioning of the mold therewithin, the injection of the molten acrylic into the mold cavity and the circulation of the cooling water through the cooling channels of the mold is well known to those skilled in the art and need not be discussed in detail herein.

After the acrylic material which has been introduced into mold chamber 78 under substantial pressure is appropriately cooled, the first and second mold components 72 and 74 are separated and the molded product which is of the general character illustrated in FIG. 22 is removed from the molds using a mold separation and removal mechanism 120. Removal mechanism 120, which includes a plurality of pusher rods 122, is of a character well known to those skilled in the art and functions to enable damage-free removal of the cooled plaque from the mold cavity (see FIGS. 15 and 17).

Following removal of the molded article from the mold, the spew 112 (FIG. 22) is suitably removed in the manner previously described and the lower surface of connector 38 is suitably smoothed as by grinding to form the generally cylindrically shaped connector element 38.

The injection molded award plaque, which is produced in accordance with the aforementioned molding method, includes the previously mentioned, strategically formed bevels that optically mask the mold lines generated during the injection molding process. The plaque also includes the previously mentioned, fossil-like decorative design or image which is formed by insert 100 and which uniquely appears to be embedded in the central body portion of the plaque. When the injection molded plaque is mounted on the supporting base of the achievement award, light will shine through the plaque in a manner to attractively accentuate the fossil-like design aspect of the plaque.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An achievement award plaque including an injection molded, substantially transparent body comprising:

(a) a central portion of a first thickness, said central portion having a generally planar front face and a spaced-apart, generally planar rear face, said rear face being generally parallel to said front face and having a concave ornamental impression formed therein, said ornamental impression extending outwardly in a direction toward said front face;

(b) a marginal portion having a front surface and a rear surface, said marginal portion circumscribing said central portion and being of a second thickness greater than said first thickness;

(c) an angularly inwardly extending wall circumscribing said central portion, said inwardly extending wall being connected to said rear surface of said marginal portion and terminating at a location proximate said rear surface of said central portion; and (d) a generally V-shaped channel circumscribing said central portion of said substantially transparent body and being disposed between said central portion and said inwardly extending wall.

2. A plaque as defined in claim 1 in which said marginal portion includes a side wall circumscribing said angularly inwardly extending wall and further includes a bevel interconnecting said side wall and said front surface of said marginal portion.

3. A plaque as defined in claim 1 further including an outwardly extending integrally formed connector means for interconnecting said body with a supporting base.

4. A plaque as defined in claim 1 in which said ornamental impression has the shape of a person.

5. A plaque as defined in claim 4 in which said ornamental impression has the shape of a golfer.

6. An achievement award comprising:

(a) a supporting base; and (b) a plaque connected to said supporting base, said plaque including an injection molded body comprising;

(i) a central portion of a first thickness said central portion having a front face and a rear face, said rear face having a concave ornamental impression formed therein, said ornamental impression extending outwardly in a direction toward said front face;

(ii) a marginal portion having a front surface and a rear surface, said marginal portion being of a second thickness and circumscribing said central portion; and (iii) an angularly inwardly extending wall circumscribing said central portion, and interconnecting said rear surface of said marginal portion with said rear face of said central portion; and (iv) a generally V-shaped channel circumscribing said central portion and being disposed between said central portion and said inwardly extending wall.

7. An award as defined in claim 6 in which said injection molded body portion includes an outwardly extending connector means for interconnecting said body with a supporting base.

8. An award as defined in claim 7 in which said supporting base is provided with a connector receiving channel and in which said connector means includes an elongated connector element formed on said marginal portion of said injection molded body, said connector element being receivable with said connector receiving channel.

9. An award as defined in claim 8 in which said supporting base comprises:

(a) a surface member having an upper surface and a lower, object engaging surface; and (b) a plaque supporting member connected to said surface engaging member.

10. An award as defined in claim 9 in which said connector receiving channel includes locking means for lockably engaging said connector element.

11. An award as defined in claim 10 in which said connector element is generally tubular shaped and in which said locking means comprises yieldably deformable gripping means for gripping said generally tubular shaped connector element.

12. An injection mold for molding an achievement award plaque comprising:

(a) a first mold component having a body provided with a first cavity defined by a first generally planar face and a side wall connected to and circumscribing said generally planar face;

(b) a second mold component removably connected to said first mold component, said second mold component having an upstanding portion partially receivable within said cavity of said first mold component, said upstanding portion having a generally planar surface circumscribed by an angularly extending first wall and an angularly extending second wall which cooperate to define a generally triangular shaped, upstanding protuberance, said second wall interconnecting said generally planar surface with said angularly extending first wall, at least one of said first and second mold components having an injection passageway in communication with said cavity of said first mold component for permitting the flow of plastic into said cavity; and (c) a three dimensional insert disposed intermediate said first generally planar face of said first mold component and said generally planar surface of said upstanding portion of said second mold component.

13. An injection mold as defined in claim 12 in which at least one of said first and second mold components includes a second cavity disposed proximate said first cavity of said first mold component, said second cavity being in communication with said injection passageway.

14. An injection mold as defined in claim 12 in which said three dimensional insert is removably connected to said generally planar surface of said upstanding portion of said second mold component.

15. an injection mold as defined in claim 12 in which said three dimensional insert has the general appearance of a person.

16. A method of making an achievement award plaque comprising the steps of:

(a) constructing a first mold component having a body provided with a first cavity defined by a first generally planar face;

(b) constructing a second mold component having an upstanding portion which is partially receivable within said cavity of said first mold component, said upstanding portion having a generally planar surface circumscribed by an angularly disposed outer wall and an angularly disposed inner wall which cooperate with said first mold component to form strategically configured bevels on the plague, said inner wall interconnecting said generally planar surface with said angularly disposed outer wall, at least one of said first and second mold components being constructed so as to have an injection passageway for permitting the flow of plastic therethrough;

(c) constructing a three dimensional insert having an external surface defining a shape;

(d) positioning said three dimensional insert on said generally planar surface of said second mold component to form an assemblage;

(e) placing said first mold component over said assemblage in a manner such that said generally planar surface of said second mold component and said three dimensional insert extend into said cavity of said first mold component to form a molding chamber;

(f) sealably interconnecting said first and second mold components;

(g) heating an acrylic material to an elevated temperature of between about 400 and 480 degrees centigrade to form a heated acrylic;

(h) introducing said heated acrylic into said injection passageway in an amount sufficient to fill said molding chamber;

(i) permitting said heated acrylic to cool;

(j) separating said first and second mold components; and (k) removing said acrylic material from said molding chamber.

17. a method as defined in claim 16 in which said three dimensional insert is constructed in the shape of a person.

18. A method as defined in claim 16 in which said heated acrylic is injected into said injection passageway at a pressure of approximately 13,000 pounds per square inch.

19. A method as defined in claim 18 in which said heated acrylic is retained within said molding chamber for approximately 140 seconds.

20. An achievement award plaque including an injection molded, substantially transparent body comprising:

(a) a central portion of a first thickness, said central portion having a front face and a rear face, said rear face having a concave ornamental impression formed therein, said ornamental impression extending outwardly in a direction toward said front face;

(b) a marginal portion having a front surface and a rear surface, said marginal portion circumscribing said central portion and being of a second thickness greater than said first thickness;

(c) an angularly inwardly extending wall circumscribing said central portion, said inwardly extending wall being connected to said rear surface of said marginal portion and terminating at a location proximate said rear surface of said central portion; and (d) a generally V-shaped channel circumscribing said central portion of said substantially transparent body and being disposed between said central portion and said inwardly extending wall.

21. A plaque as defined in claim 20 in which said marginal portion includes a side wall circumscribing said angularly inwardly extending wall and further includes a bevel interconnecting said side wall and said front surface of said marginal portion.

22. A plaque as defined in claim 21 further including an outwardly extending integrally formed means for interconnecting said body with a supporting base.

23. An achievement award comprising:

(a) an upper supporting base having an upper surface provided with an elongated connector receiving channel;

(b) a plaque connected to said supporting base, said plaque including an injection molded body comprising;

(i) a central portion of a first thickness aid central portion having a front face and a rear face, said rear face having a concave ornamental impression formed therein, said ornamental impression extending outwardly in a direction toward said front face;

(ii) a marginal portion having a front surface and a rear surface, said marginal portion being of a second thickness and circumscribing said central portion; and (iii) an angularly inwardly extending wall circumscribing said central portion, and interconnecting said rear surface of said marginal portion with said rear face of said central portion; and (iv) an outwardly extending connector means for interconnecting said body with a supporting base, said connector means comprising an elongated connector element integrally formed with said marginal portion of said injection molded body, said connector element being receivable with said elongated connector receiving channel provided in said upper surface of said base.

24. An award as defined in claim 23 in which said connector receiving channel includes locking means for lockably engaging said connector element.

25. An award as defined in claim 24 in which said connector element is generally tubular shaped and in which said locking means comprises yieldably deformable gripping means for gripping said generally tubular shaped connector element.

* * * * *